United States Patent [19]

Pocklington et al.

[11] Patent Number: 4,932,664

[45] Date of Patent: Jun. 12, 1990

[54] GOLF BALL

[75] Inventors: Terence W. Pocklington, Tupelo; William L. Crausby, Pontotoc, both of Miss.

[73] Assignee: Ram Golf Corporation, Melrose Park, Ill.

[21] Appl. No.: 358,250

[22] Filed: May 30, 1989

[51] Int. Cl.[5] ..... A63B 37/14

[52] U.S. Cl. ..... 273/232; 273/213

[58] Field of Search ..... 273/62, 232, 220, 235 R, 273/213; 40/327

[56] References Cited

FOREIGN PATENT DOCUMENTS 0217483 4/1987 European Pat. Off. ..... 273/232

0234081 9/1987 European Pat. Off. ..... 273/232

*Primary Examiner*—George J. Marlo

*Attorney, Agent, or Firm*—James P. Ryther

[57] ABSTRACT

A golf ball construction wherein the dimples are evenly distributed over the surface to minimize the appearance and effect of an unbroken seam line. The dimples are arranged in three different patterns comprising a pentagon formation at each of the poles, five equally-spaced trapezoid formations in each hemisphere located between the pentagon pattern and the equator, and five equally-spaced triangular formations interposed between the trapezoid formations. The diameter of the dimples is also controlled to maintain the uniformity of the spacing.

8 Claims, 2 Drawing Sheets

GOLF BALL

BACKGROUND OF THE INVENTION

This invention relates to golf balls and in particular to golf balls having dimples formed on the surface. The golf balls are of conventional design in the sense that specifications of the United States Golf Association are complied with from the standpoint of parameters such as an outer diameter of a minimum of 1.680 inches. Similarly, conventional dimple depths of about 0.01 to about 0.015 inches are contemplated.

In the manufacture of golf balls of either a two-piece or three-piece variety, one method used is compression molding wherein two hemispherical cover shells are applied over a core and joined at the equatorial seam by heat and pressure. This results in a "seam line" free of any dimples which creates certain functional and aesthetic problems. As to function, non-uniformity of the dimple pattern yields less satisfactory results from the standpoint of consistency of performance.

From an aesthetic point of view, if the golf balls are randomly oriented for imprinting of trademarks and other information thereon, the seam line can create the optical illusion that the ball is not spherical, or can otherwise give the impression of an improperly produced ball. For this reason, it has been necessary to carefully orient some balls before imprinting in order to produce a ball with the best possible appearance.

SUMMARY OF THE INVENTION

In accordance with this invention, a golf ball is produced with a pattern of dimples designed to minimize any appearance of an unbroken seam line. This enables the production of golf balls characterized by consistent performance and also suitable for random imprinting thereby minimizing the cost associated with that operation.

Considering the parting line between the hemispheres of the ball as the equator, the pattern of dimples includes a pentagon formation of a plurality of dimples at each of the poles. In each of the areas between these formations and the equator, there are five equally-spaced trapezoid formations of a plurality of dimples. Interposed between the trapezoid formations are a plurality of equally-spaced triangular formations of a plurality of dimples.

In the preferred form of the invention, each of the pentagon formations includes 51 dimples, each of the trapezoid formations includes 21 dimples, and each of the triangular formations includes ten dimples. This provides 206 dimples in each hemisphere for a total of 412 dimples on the surface of the ball.

The diameters of the dimples are preferably controlled to enhance the uniformity of appearance. Typically, the diameters of the dimples will depend on the number thereof; thus, where greater numbers of dimples are employed, the diameter will be smaller, and vice versa. The diameters are also dependent on the "spacing" between dimples which is defined as the distance between the closest points of the edges of adjacent dimples. Typically, dimple diameters will vary between about 0.130 and about 0.175 inches, and the spacing between at or near touching to about 0.070 inches.

In the preferred form of this invention, the dimple diameters and spacing are varied to achieve the maximum uniformity. Where 412 dimples are employed, 392 of these dimples have a diameter of about 0.145 inches and 20 a diameter of 0.155 inches. The latter are divided evenly into each hemisphere and located at selected points therein to achieve the appearance of uniformity. This arrangement permits a maximum spacing of about 0.070 inches with some dimples spaced about 0.001 inches apart, that is, at or near touching.

To further enhance the appearance of uniformity, the respective alternating bases of the trapezoid and triangular formations form a line of dimples on one side of the equator and these bases are disposed opposite a base of the other formation on the other side of the equator. Thus, dimples forming a trapezoid base on one side of the equator are disposed opposite dimples forming a triangular base on the other side of the equator. Moreover, respective trapezoid and triangular bases preferably include different numbers of dimples, and there will then be no direct facing relationship of dimples on opposite sides of the equator. Where the preferred form of the invention is utilized, the trapezoid bases along the equator include three dimples and the triangular bases four dimples.

DESCRIPTION OF THE PREFERRED EMBODIMENT

Figure 1:
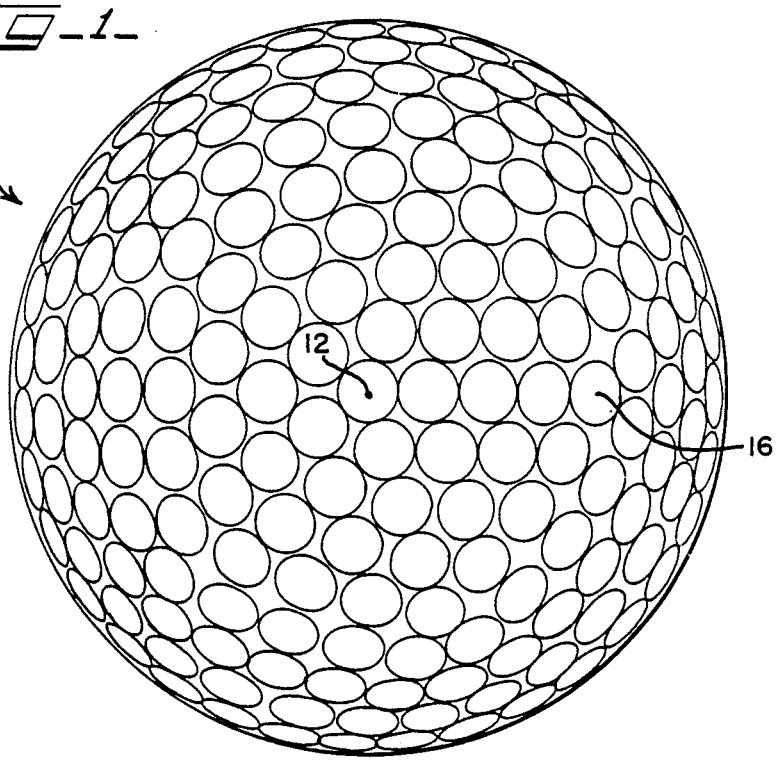
FIG. 1 illustrates a plan view of a golf ball produced in accordance with this invention.

The golf ball 10 shown in the drawings includes a pole position 12 and a seam line 14. The surface of the ball includes dimples 16 formed in any conventional fashion.

Figure 2:
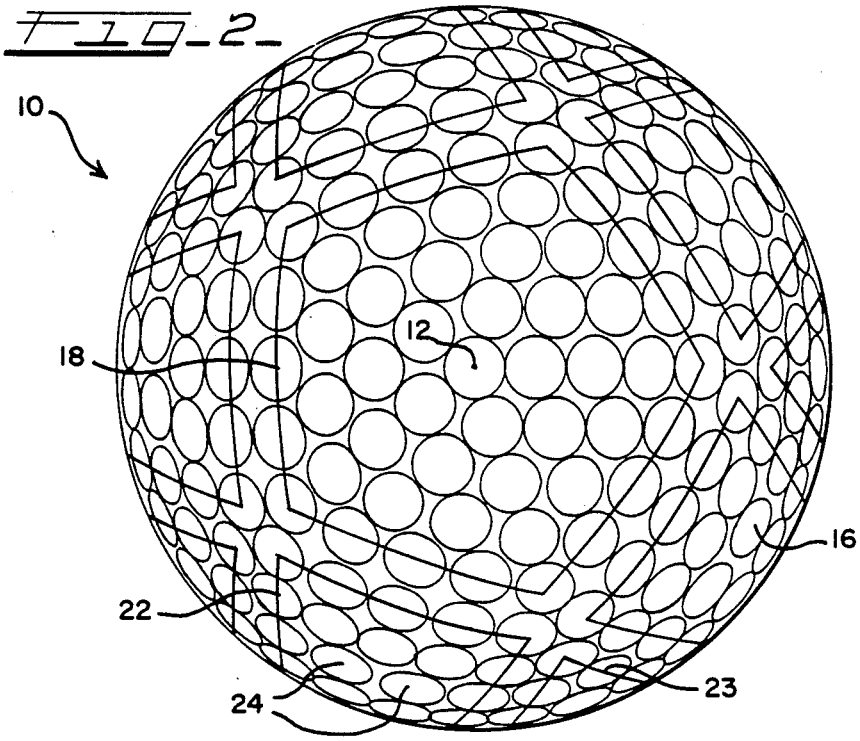
FIG. 2 comprises the same view of the golf ball of FIG. 1 while showing the patterns of different dimple formations; and, FIG. 3 is an approximate side elevation of the golf ball of FIG. 1 showing the patterns of the different dimple formations.
Figure 3:
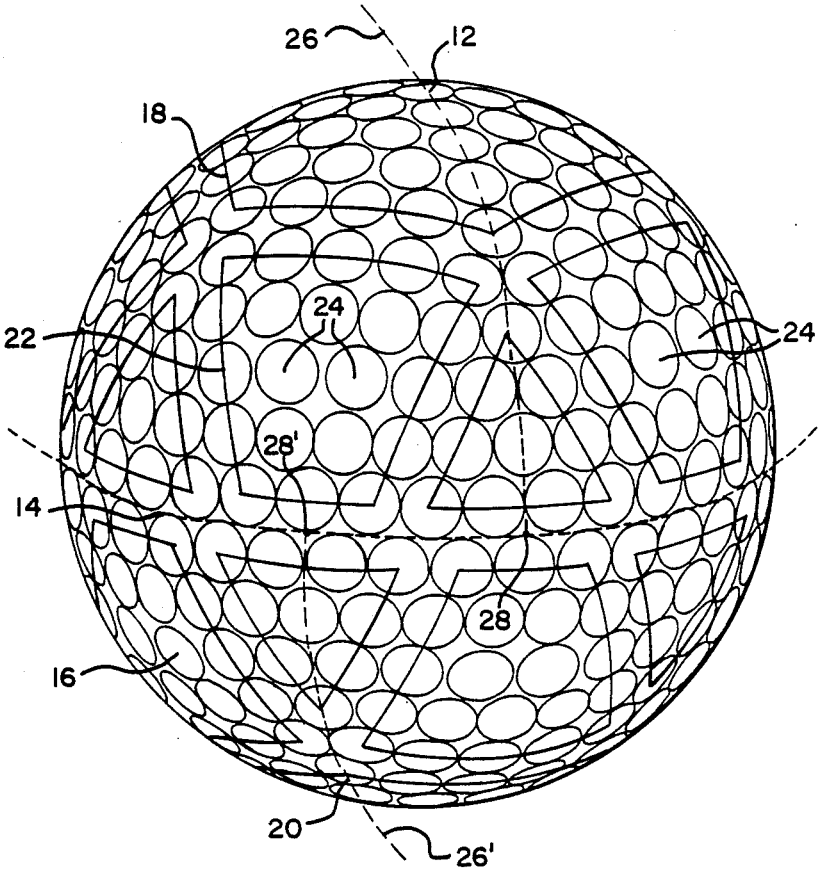

As best shown in FIGS. 2 and 3, the dimples are divided into different formations including a pentagon formation 18 having a center dimple at the pole 12 in the hemisphere shown in FIG. 2. A second pentagon formation 20 is formed around the pole of the other hemisphere. Each pentagon formation consists of five triangular areas, and 51 dimples make up each such formation.

A trapezoid formation 22 is formed adjacent each side of the pentagon formation. In the embodiment shown, the sides of the pentagon formation are formed of five dimples and each of the trapezoid formations includes five dimples at the larger base thereof. These trapezoid formations are interposed between the pentagon formations and the seam line or "equator" of the ball. The trapezoid formations include two rows of five dimples, two rows of four dimples, and a smaller base row of three dimples, for a total of 21 dimples.

Interposed between each trapezoid formation is a triangular formation 23 of ten dimples including a base of four dimples. The combination of the dimples in the smaller bases of the trapezoid formations and in the triangular formation bases, provides a line of dimples on each side of the equator. It will be noted that the triangular bases are disposed opposite the trapezoid bases whereby four dimples are disposed opposite three dimples. This enhances the uniformity of appearance by avoiding a direct "face-to-face" relationship of dimples, that is, by achieving a relationship at the seam line which is similar to the relationship achieved at substantially all other surface locations.

The spacing between dimples varies slightly, as shown, from about 0.070 inches at the greatest, to a substantially touching relationship. Where desired, the spacing can be increased by reducing the dimple diameter. Although not preferred, the pattern of formations can be repeated using formations with fewer dimples which would preferably be of larger diameter.

The preferred dimple diameter is about 0.145 inches, however, it has been found that by including a relatively few (between 2 and 10%) dimples of a diameter of about 0.155 inches, greater uniformity of appearance is achieved. In the illustrated embodiment, where 412 dimples are utilized, 392 of the dimples have a diameter of 0.145 inches and 20 have a diameter of 0.155 inches. Dimples 24 shown in FIGS. 2 and 3 illustrate larger diameter dimples, and it will be noted that these are divided into pairs which are positioned within each of the respective trapezoid formations.

Following is a chart identifying the dimple center point locations for each of the 412 dimples utilized in the golf ball comprising the preferred embodiment of the invention. In this chart, "VERT ANG" refers to the degrees and minutes above or below the seam line 14 which is considered at 0°. "HOR ANG" refers to the degrees and minutes from the longitudinal lines 26 and 26' which are considered at 0° and which extend, in the respective hemispheres, between a pole and the equator. The intersections of these lines with the equator, at 28 and 28', are thus the 0° vertical and 0° horizontal position for the upper and lower hemispheres, respectively.

| VERT. ANG. | | HORIZ. ANG. | | | | | | | | | |
|---|---|---|---|---|---|---|---|---|---|---|---|
| DIMPLE DIAMETER 0.145 | | | | | | | | | | | |
| 5d | 10 | 5d | 9 | 15d | 26 | 25d | 43 | 36d | 0 | 46d | 17 |
| | | 56d | 34 | 66d | 51 | 77d | 8 | 87d | 25 | 97d | 42 |
| | | 108d | 0 | 118d | 17 | 128d | 34 | 138d | 51 | 149d | 8 |
| | | 159d | 25 | 169d | 42 | 180d | 0 | 190d | 17 | 200d | 34 |
| | | 210d | 51 | 221d | 8 | 231d | 25 | 241d | 42 | 252d | 0 |
| | | 262d | 17 | 272d | 34 | 282d | 51 | 293d | 8 | 303d | 25 |
| | | 313d | 42 | 324d | 0 | 334d | 17 | 344d | 34 | 354d | 51 |
| 14d | 10 | 10d | 17 | 20d | 34 | | | | | 51d | 25 |
| | | 61d | 42 | | | 82d | 17 | 92d | 34 | | |
| | | | | 123d | 25 | 133d | 42 | | | 154d | 17 |
| | | 164d | 34 | | | | | 195d | 25 | 205d | 42 |
| | | | | 226d | 17 | 236d | 34 | | | | |
| | | 267d | 25 | 277d | 42 | | | 298d | 17 | 308d | 34 |
| | | | | | | 339d | 25 | 349d | 42 | | |
| 14d | 30 | 0d | 0 | 72d | 0 | 144d | 0 | 216d | 0 | 288d | 0 |
| 14d | 40 | 30d | 51 | 41d | 8 | 102d | 51 | 113d | 8 | 174d | 51 |
| | | 185d | 8 | 246d | 51 | 257d | 8 | 318d | 51 | 329d | 8 |
| 23d | 15 | 6d | 0 | 66d | 0 | 78d | 0 | 138d | 0 | 150d | 0 |
| | | 210d | 0 | 222d | 0 | 282d | 0 | 294d | 0 | 354d | 0 |
| 23d | 30 | 17d | 15 | 54d | 45 | 89d | 15 | 126d | 45 | 161d | 15 |
| | | 198d | 45 | 233d | 15 | 270d | 45 | 305d | 15 | 342d | 45 |
| 32d | 18 | 0d | 0 | 72d | 0 | 144d | 0 | 216d | 0 | 288d | 0 |
| 32d | 35 | 12d | 30 | 59d | 30 | 84d | 30 | 131d | 30 | 156d | 30 |
| | | 203d | 30 | 228d | 30 | 275d | 30 | 300d | 30 | 347d | 30 |
| 34d | 58 | 24d | 0 | 48d | 0 | 96d | 0 | 120d | 0 | 168d | 0 |
| | | 192d | 0 | 240d | 0 | 264d | 0 | 312d | 0 | 336d | 0 |
| 35d | 49 | 36d | 0 | 108d | 0 | 180d | 0 | 252d | 0 | 324d | 0 |
| 41d | 20 | 6d | 50 | 65d | 10 | 78d | 50 | 137d | 10 | 150d | 50 |
| | | 209d | 10 | 222d | 50 | 281d | 10 | 294d | 50 | 353d | 10 |
| 44d | 34 | 20d | 45 | 51d | 15 | 92d | 45 | 123d | 15 | 164d | 45 |
| | | 195d | 15 | 236d | 45 | 267d | 15 | 308d | 45 | 339d | 15 |
| 45d | 40 | 36d | 0 | 108d | 0 | 180d | 0 | 252d | 0 | 324d | 0 |
| 49d | 58 | 0d | 0 | 72d | 0 | 144d | 0 | 216d | 0 | 288d | 0 |
| 54d | 39 | 16d | 52 | 55d | 8 | 88d | 52 | 127d | 8 | 160d | 53 |
| | | 199d | 8 | 232d | 52 | 271d | 8 | 304d | 52 | 343d | 8 |
| 56d | 5 | 36d | 0 | 108d | 0 | 180d | 0 | 252d | 0 | 324d | 0 |
| 60d | 33 | 0d | 0 | 72d | 0 | 144d | 0 | 216d | 0 | 288d | 0 |

-continued

| VERT. ANG. | | HORIZ. ANG. | | | | | | | | | |
|---|---|---|---|---|---|---|---|---|---|---|---|
| 64d | 17 | 23d | 0 | 49d | 0 | 95d | 0 | 121d | 0 | 167d | 0 |
| | | 193d | 0 | 239d | 0 | 265d | 0 | 311d | 0 | 337d | 0 |
| 70d | 22 | 0d | 0 | 72d | 0 | 144d | 0 | 216d | 0 | 288d | 0 |
| 73d | 25 | 36d | 0 | 108d | 0 | 180d | 0 | 252d | 0 | 324d | 0 |
| 80d | 11 | 0d | 0 | 72d | 0 | 144d | 0 | 216d | 0 | 288d | 0 |
| 90d | 0 | 0d | 0 | | | | | | | | |
| DIMPLE DIAMETER 0.155 | | | | | | | | | | | |
| 25d | 20 | 29d | 13 | 42d | 47 | 101d | 13 | 114d | 47 | 173d | 13 |
| | | 186d | 47 | 245d | 13 | 258d | 47 | 317d | 13 | 330d | 47 |

To further illustrate the chart content, it will be noted that thirty-five of the dimple center points in the bases of the trapezoid and triangular formations are located 5 degrees 10 minutes either above or below the seam line. The first dimple of the thirty-five in the upper hemisphere to the right of line 26 has a center point 5 degrees, 9 minutes from this line, and the next dimple center point is 15 degrees, 26 minutes from this line. Each successive dimple position is shown up to the 35th dimple which is located 354 degrees 51 minutes from the longitudinal line 26. This dimple is, of course, adjacent the first dimple.

The same relationship prevails in the lower hemisphere with the longitudinal line 26' extending from the zero degree reference point 28'. Thus, the first of the 35 dimples along the seam line will have its center point 5 degrees, 10 minutes below the seam line 14, and 5 degrees, 9 minutes horizontally from the point 28'.

The chart also illustrates the positions of each of the remaining dimples. Thus, the thirty-five dimples immediately above and below the seam line dimples have center points varying between 14 degrees, 10 minutes and 14 degrees, 40 minutes above and below the seam line. The first dimple in this group (at a vertical angle of 14 degrees, 30 minutes) is centered on the line 26. The first dimple to the right of longitudinal line 26 (at a vertical angle of 14 degrees, 10 minutes) has a center point 10 degrees, 17 minutes from that line. The last dimple in this group (also at a vertical angle of 14 degrees, 10 minutes) has a center point 349 degrees, 42 minutes from the line 26.

The angles for the vertical locations shown progress to the 90 degrees, 0 minutes pole location where the single dimple 12 is located.

The chart also distinguishes the locations of the 196 dimples in each hemisphere which are approximately 0.145 inches in diameter from those of the 10 dimples in each hemisphere which are approximately 0.155 inches in diameter. Thus, it will be noted that the first pair of dimples 24 to the right of line 26 in the upper hemisphere (dimples having the larger diameter) have a center point 25 degrees, 20 minutes above the seam line. The first of these is located 29 degrees, 13 minutes away from line 26, and the second is located 42 degrees, 47 minutes from line 26.

It will be understood that various changes and modifications may be made in the above-described invention without departing from the spirit of the invention particularly as set forth in the following claims.

We claim:

1. In a golf ball construction wherein a plurality of dimples are formed on a spherical surface, said surface defining opposite poles and an equator midway between said poles dividing said surface into two hemispheres, the improvement in the pattern of the dimples formed on said surface, said pattern including:

(a) a pole dimple located at each pole;

(b) a pentagon formation of dimples in each hemisphere comprising five equally-spaced lines of dimples radiating outwardly from said pole dimple to thereby define five triangular areas in said pentagon formation, and additional dimples located between said lines;

(c) five equally-spaced trapezoid formations of dimples in each hemisphere interposed between the equator; and, (d) five equally-spaced triangular formations in each hemisphere of dimples interposed between said trapezoid formations;

said dimples being substantially uniformly spaced over said surface.

2. A golf ball according to claim 1 wherein each of said pentagon formations includes 51 dimples, each of said trapezoid formations includes 21 dimples, and each of said triangular formations includes 10 dimples, said surface thereby having 412 dimples formed thereon.

3. A golf ball according to claim 1 wherein said dimples range in diameter from about 0.130 inches to about 0.175 inches.

4. A golf ball according to claim 3 wherein 206 dimples are located in each hemisphere.

5. A golf ball according to either of claims 2 or 4 wherein 196 of the dimples in each hemisphere are about 0.145 inches in diameter, and 10 of the dimples in each hemisphere are about 0.155 inches in diameter.

6. A golf ball according to claim 5 wherein the ten dimples of about 0.155 inches in diameter are positioned within each of said trapezoid formations.

7. A golf ball according to claim 1 wherein alternating bases of trapezoid and triangular formations form a line of dimples on one side of said equator, and alternating bases of trapezoid and triangular formations form a line of dimples on the other side of the equator, and wherein the base of a trapezoid formation on one side of the equator is disposed opposite the base of a triangular formation on the other side of the equator.

8. A golf ball according to claim 7 wherein a triangular base is formed of a different number of dimples than a trapezoid base whereby dimples on opposite sides of the equator are not disposed in direct facing relationship.

* * * * *